US011806598B2

(12) United States Patent
Mann et al.

(10) Patent No.: US 11,806,598 B2
(45) Date of Patent: Nov. 7, 2023

(54) SAFETY BARRIER FOR PLAY APPARATUS

(71) Applicant: Robovision Limited, Flitwick (GB)

(72) Inventors: Miles Mann, Flitwick (GB); William Baylis, Flitwick (GB); Helena Lewis, Flitwick (GB)

(73) Assignee: ROBOVISION LIMITED, Flitwick (GB)

( * ) Notice: Subject to any disclaimer, the term of this patent is extended or adjusted under 35 U.S.C. 154(b) by 301 days.

(21) Appl. No.: 17/050,223

(22) PCT Filed: Dec. 11, 2018

(86) PCT No.: PCT/GB2018/053589

§ 371 (c)(1),
(2) Date: Oct. 23, 2020

(87) PCT Pub. No.: WO2019/207269

PCT Pub. Date: Oct. 31, 2019

(65) Prior Publication Data

US 2021/0228967 A1 Jul. 29, 2021

(30) Foreign Application Priority Data

Apr. 25, 2018 (GB) ..... 1806733

(51) Int. Cl.
*A63B 71/02* (2006.01)
*A63B 5/11* (2006.01)
*A63B 71/00* (2006.01)

(52) U.S. Cl.
CPC ..... *A63B 71/022* (2013.01); *A63B 5/11* (2013.01); *A63B 71/0054* (2013.01); *A63B 71/023* (2013.01); *A63B 2210/50* (2013.01)

(58) Field of Classification Search
CPC ..... A63B 71/022; A63B 5/11; A63B 2210/50; A63B 71/0054; A63B 71/023; E04H 15/02
See application file for complete search history.

(56) References Cited

U.S. PATENT DOCUMENTS 4,474,369 A 10/1984 Gordan
9,446,274 B1 9/2016 Chen
(Continued)

FOREIGN PATENT DOCUMENTS

CN 2936312 Y 8/2007
CN 200984410 Y 12/2007
(Continued)

OTHER PUBLICATIONS

International Search Report from corresponding International Application No. PCT/GB2018/053589 dated Apr. 25, 2019, 5 pages.
(Continued)

*Primary Examiner* — Megan Anderson
*Assistant Examiner* — Sara K. Conway
(74) *Attorney, Agent, or Firm* — TUCKER ELLIS LLP

(57) ABSTRACT

A safety barrier for use with a play apparatus such as a trampoline includes at least one support pole and a barrier element. A portion of the barrier element is detachably connectable directly or indirectly to the support pole, the barrier element having an erect configuration and a collapsed configuration. In the erect configuration the portion of the barrier element is connected directly or indirectly to the support pole and in the collapsed configuration the portion of the barrier element is not connected directly or indirectly to the support pole.

10 Claims, 12 Drawing Sheets

(56) References Cited

U.S. PATENT DOCUMENTS

| | | | | |
|---|---|---|---|---|
| 2012/0252634 | A1* | 10/2012 | Ikegami | A63B 71/0054 482/29 |
| 2012/0289379 | A1* | 11/2012 | Stokes | A63B 5/11 482/27 |
| 2013/0190137 | A1 | 7/2013 | Kim et al. | |
| 2013/0310223 | A1 | 11/2013 | Canales et al. | |
| 2017/0239503 | A1* | 8/2017 | Goldwitz | A63B 5/11 |
| 2017/0319886 | A1 | 11/2017 | Chen | |
| 2017/0326399 | A1* | 11/2017 | Woodman | A63B 71/023 |
| 2019/0091540 | A1* | 3/2019 | Chen | A63B 71/022 |

FOREIGN PATENT DOCUMENTS

| | | | |
|---|---|---|---|
| CN | 203750092 | U | 8/2014 |
| GB | 2516510 | A | 1/2015 |
| KR | 101339642 | B1 | 12/2013 |
| KR | 1020140048557 | A | 4/2014 |
| KR | 1020150066391 | A | 6/2015 |
| KR | 101550539 | B1 | 9/2015 |
| KR | 1020150141012 | A | 3/2016 |
| WO | 2016074023 | A1 | 5/2016 |
| WO | 2017070739 | A1 | 5/2017 |

OTHER PUBLICATIONS

Search Report from corresponding Great Britain Application No. 1806733.0, dated Sep. 3, 2018, 4 pages.
Examination Report from corresponding Australian Application No. 2019101399 dated Feb. 6, 2020, 3 pages.
Examination Report from corresponding Australian Application No. 2019101399 dated Apr. 29, 2020, 3 pages.

* cited by examiner 30
36

30
36
34
4'

28
501
38

32
28
38
4'
A
38
41b
28
281b 281b
282
28
38
280
281a
41a

SAFETY BARRIER FOR PLAY APPARATUS

RELATED APPLICATION DATA

This application is a national phase application of International Application No. PCT/GB2018/053589 filed Dec. 11, 2018, published in the English language, and which claims priority to application number GB 1806733.0 filed Apr. 25, 2018. The entireties of the aforementioned applications are incorporated herein by reference.

The present disclosure relates to a play apparatus, more particularly a trampoline. The disclosure also relates to a safety barrier, e.g. a safety surround, for use with a play apparatus such as a trampoline.

Trampolines are popular items of play apparatus. Many households have trampolines in their gardens. Such trampolines generally comprise a flexible bounce mat connected to a frame by a plurality of springs such that the flexible bounce mat is held above the ground in tension. Often such trampolines also comprise a surround arranged to prevent users falling on to the springs and/or off the trampoline.

A first aspect provides a trampoline comprising a bounce area, wherein the bounce area is configured such that a first portion of the bounce area is disposed in a first plane and a second portion of the bounce area is disposed in a second plane, the second plane being different from the first plane.

The bounce area comprises a plurality of portions, at least two of which are disposed in different planes from each other.

By providing a bounce area comprising a plurality of portions, at least two of which are disposed in different planes from each other, the trampoline may provide users with a more entertaining and/or enjoyable experience.

A third portion of the bounce area may be disposed in a third plane. The third plane may be different from the first plane and/or different from the second plane.

The bounce area may comprise a fourth portion disposed in a fourth plane, a fifth portion disposed in a fifth plane, a sixth portion disposed in a sixth plane and so on.

Two of more of the planes in which portions of the bounce area are disposed may be parallel.

The bounce area may be tiered and/or stepped.

The bounce area may provide a plurality of bounce surfaces, e.g. bounce levels.

The portions of the bounce area may be of different or the same sizes and shapes from each other.

The first portion may have a larger area than the second portion or vice versa.

The bounce area may comprise a single piece of material or a plurality of pieces of material. The plurality of pieces of material may be joined together by one or more suitable joining or bonding means or technique, e.g. adhesive, sewing or welding.

The trampoline may comprise a frame. The frame may extend at least partially around the bounce area. The bounce area may be connected to the frame by a plurality of resilient members. The resilient members may be spaced, regularly or irregularly, around the perimeter of the bounce area. The resilient members may comprise springs, e.g. coil springs or leaf springs. The resilient members may comprise flexible rods, e.g. flexible composite rods. The resilient members may comprise an elasticated material, e.g. the resilient members may comprise elasticated cords or webbing. The resilient members may be disposed at least partially substantially in the planes of the bounce area. The resilient members may be disposed at least partially out of the planes of the bounce area. For example, the resilient members may extend a distance below the bounce area. The resilient members may be arranged such that they are disposed at least in part, e.g. entirely, outside the perimeter of the bounce area. The resilient members may be arranged such that they are disposed at least in part, e.g. entirely, within the perimeter of the bounce area.

The trampoline may comprise a cover extending over at least some of the resilient members. At least a portion of the cover may be padded. For instance, a padded entry mat may be provided on a portion of the cover.

The frame may comprise one of more, e.g. a plurality of, legs.

The frame may comprise a crossbar extending a distance underneath the bounce area. One or more resilient members may connect the crossbar to an underside of the bounce area, e.g. at a point or region where one portion of the bounce area in a first plane meets another portion of the bounce area in a second plane, the second plane being different from the first plane. The resilient members may be spaced, regularly or irregularly, along at least a portion of a length of the crossbar. The resilient members may comprise springs, e.g. coil springs or leaf springs. The resilient members may comprise flexible rods, e.g. flexible composite rods. The resilient members may comprise an elasticated material, e.g. the resilient members may comprise elasticated cords or webbing.

The trampoline may comprise a surround extending above and at least partially around the bounce area.

The surround may comprise an entry system to allow a user to access and exit the bounce area.

The entry system may comprise one or more apertures, doorways or flaps.

The entry system may comprise an externally facing first doorway comprising a first aperture, and an internally facing second doorway comprising a second aperture, said first and second apertures being substantially non-aligned with one another and being in communication with one another via an access space.

The access space may be bounded by an inner wall and an outer wall created from portions of the material of the surround. The inner and outer walls may overlap to create the access space. The access space may comprise an access tunnel.

The portion of material of the surround forming one of the inner and outer walls may be attached, e.g. along a seam, to the portion of material of the surround forming the other of the inner and outer walls, so as to at least partially enclose the access space and create an access tunnel therefrom.

The surround may be collapsible.

The surround may comprise a safety barrier according to any aspect or embodiment disclosed herein.

The trampoline may be provided with a protective cover for at least partially covering the trampoline when not in use. The protective cover may be in accordance with any aspect of embodiment disclosed herein.

A second aspect provides a safety barrier for use with a play apparatus such as a trampoline comprising: at least one support pole and a barrier element, wherein a portion of the barrier element is detachably connectable directly or indirectly to the support pole, the barrier element having an erect configuration and a collapsed configuration, wherein in the erect configuration the portion of the barrier element is connected directly or indirectly to the support pole and in the collapsed configuration the portion of the barrier element is not connected directly or indirectly to the support pole.

The safety barrier may comprise a plurality of support poles.

In the erect configuration the portion(s) of the barrier element may be connected directly or indirectly to one or more, e.g. all, of the support poles. In the collapsed configuration the portion(s) of the barrier element may be connected directly or indirectly to one or more, e.g. all, of the support poles.

The portion(s) of the barrier element connected directly or indirectly to the support pole(s) may comprise a barrier support element.

A first end of the or each support pole may be received in a support socket. The support socket may comprise a receiving portion for holding the support pole in an upright orientation. The support pole may be movable longitudinally within the receiving portion. The support pole may be movable within the support socket to a location where the support pole is pivotable relative to the support socket.

One or more elongate control members may be attached directly or indirectly to the barrier element. The elongate control member(s) may be flexible and/or inextensible. The elongate control member(s) may comprise webbing, a rope, a cord or a chain or the like.

A first end of the elongate control member may be connected directly or indirectly to the barrier element.

The barrier element may comprise a barrier support member, to which the first end of the elongate control member is connected directly or indirectly. One or more connection members disposed on the barrier support member may connect the first end of the elongate control member to the barrier support member. The barrier support member may comprise one or more barrier support member sections. The barrier support member may comprise a support loop.

The elongate control member may pass through a guide channel. When the elongate control member is flexible and passes through a guide channel, a pulley mechanism may be provided for use in erecting and/or collapsing the barrier.

The guide channel may be provided by a fitting such as a cap mounted on the support pole.

The or a fitting, e.g. the or a cap, mounted on the support pole may be configured to receive the or a connection member disposed on the or a barrier support member.

A second end of the elongate control member may be provided with an attachment member. The attachment member may be configured to engage with an attachment point. The attachment point may be located at a fixed point. The fixed point may be outboard of the barrier. The attachment point may be provided on the support pole or on the or a support socket.

The elongate control member may be adjustable in length.

A wand may be provided, the wand being configured to engage with the attachment member. The wand may help a user to collapse and/or erect the barrier element from ground level.

The barrier element may comprise a flexible material. The barrier element may comprise netting, a mesh or the like.

The safety barrier may be a surround for a play apparatus, e.g. a trampoline.

A protective cover for covering the play apparatus when the play apparatus is not in use may be provided, wherein the protective cover when placed over the play apparatus comprises one or more ridges.

The ridge(s) may limit pooling of water on, and run-off of water from, the protective cover.

The protective cover may comprise a waterproof membrane. The protective cover may be flexible at least in part. The protective cover may be foldable.

The ridge(s) may each extend at least partially across an extent of the play apparatus.

The ridge(s) may be formed at least in part by the protective cover lying on one or more portions of the or a frame. For instance, the ridge(s) may be formed at least in part by the protective cover lying on one or more support poles. The support poles may be folded in an inward direction over the or a play area.

The play apparatus may comprise a trampoline. The play area may comprise a bounce area.

A third aspect provides a safety barrier for use with a play apparatus such as a trampoline comprising: at least one support pole and a barrier element, a portion of the barrier element being connectable directly or indirectly to the support pole; wherein a first end of the support pole is received in a support socket, the support socket comprising a receiving portion for holding the support pole in an upright orientation, wherein the support pole is movable, e.g. longitudinally, in use, within the receiving portion to a location where the support pole is pivotable relative to the support socket.

The portion of the barrier element may be detachably connectable directly or indirectly to the support pole.

The barrier element may have an erect configuration and a collapsed configuration, wherein in the erect configuration the portion of the barrier element is connected directly or indirectly to the support pole and in the collapsed configuration the portion of the barrier element is not connected directly or indirectly to the support pole.

The safety barrier may comprise a plurality of support poles.

In the erect configuration the portion(s) of the barrier element may be connected directly or indirectly to one or more, e.g. all, of the support poles. In the collapsed configuration the portion(s) of the barrier element may be connected directly or indirectly to one or more, e.g. all, of the support poles.

The portion(s) of the barrier element connected directly or indirectly to the support pole(s) may comprise a barrier support element.

One or more elongate control members may be attached directly or indirectly to the barrier element. The elongate control member(s) may be flexible and/or inextensible. The elongate control member(s) may comprise webbing, a rope, a cord or a chain or the like.

A first end of the elongate control member may be connected directly or indirectly to the barrier element.

The barrier element may comprise a barrier support member, to which the first end of the elongate control member is connected directly or indirectly. One or more connection members disposed on the barrier support member may connect the first end of the elongate control member to the barrier support member. The barrier support member may comprise one or more barrier support member sections. The barrier support member may comprise a support loop.

The elongate control member may pass through a guide channel. When the elongate control member is flexible and passes through a guide channel, a pulley mechanism may be provided for use in erecting and/or collapsing the barrier.

The guide channel may be provided by a fitting such as a cap mounted on the support pole.

The or a fitting, e.g. the or a cap, mounted on the support pole may be configured to receive the or a connection member disposed on the or a barrier support member.

A second end of the elongate control member may be provided with an attachment member. The attachment member may be configured to engage with an attachment point. The attachment point may be located at a fixed point. The fixed point may be outboard of the barrier. The attachment point may be provided on the support pole or on the or a support socket.

The elongate control member may be adjustable in length.

A wand may be provided, the wand being configured to engage with the attachment member. The wand may help a user to collapse and/or erect the barrier element from ground level.

The barrier element may comprise a flexible material. The barrier element may comprise netting, a mesh or the like.

The safety barrier may be a surround for a play apparatus, e.g. a trampoline.

A protective cover for covering the play apparatus when the play apparatus is not in use may be provided, wherein the protective cover when placed over the play apparatus comprises one or more ridges.

The ridge(s) may limit pooling of water on, and run-off of water from, the protective cover.

The protective cover may comprise a waterproof membrane. The protective cover may be flexible at least in part. The protective cover may be foldable.

The ridge(s) may each extend at least partially across an extent of the play apparatus.

The ridge(s) may be formed at least in part by the protective cover lying on one or more portions of the or a frame. For instance, the ridge(s) may be formed at least in part by the protective cover lying on one or more support poles. The support poles may be folded in an inward direction over the or a play area.

The play apparatus may comprise a trampoline. The play area may comprise a bounce area.

A fourth aspect provides a play apparatus comprising a play area and a safety barrier as described herein, e.g. according to the second aspect or the third aspect, arranged at an edge of the play area.

The safety barrier may enclose at least partially the play area.

The play apparatus may comprise a trampoline having a bounce area. The safety barrier may comprise a surround extending above and at least partially around the bounce area.

The bounce area may be configured such that a first portion of the bounce area is disposed in a first plane and a second portion of the bounce area is disposed in a second plane, the second plane being different from the first plane.

A fifth aspect provides a play apparatus such as a trampoline comprising a frame and a play area, e.g. a bounce area, extending at least partially around the play area and a protective cover for covering the play area when the play apparatus is not in use, wherein the protective cover when placed over the play area comprises one or more ridges.

The ridge(s) may limit pooling of water on, and run-off of water from, the protective cover.

The protective cover may comprise a waterproof membrane. The protective cover may be flexible at least in part. The protective cover may be foldable.

The ridge(s) may each extend at least partially across an extent of the play area.

The ridge(s) may be formed at least in part by the protective cover lying on one or more portions of the frame. For instance, the ridge(s) may be formed at least in part by the protective cover lying on one or more support poles folded in an inward direction over the play area.

The play apparatus may comprise a trampoline. The play area may comprise a bounce area.

A sixth aspect provides a kit of parts arranged to be assembled to form a trampoline or a safety barrier or a surround or a play apparatus as described herein.

The person skilled in the art will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Example embodiments will now be described with reference to the accompanying drawings, in which.

Figure 1:
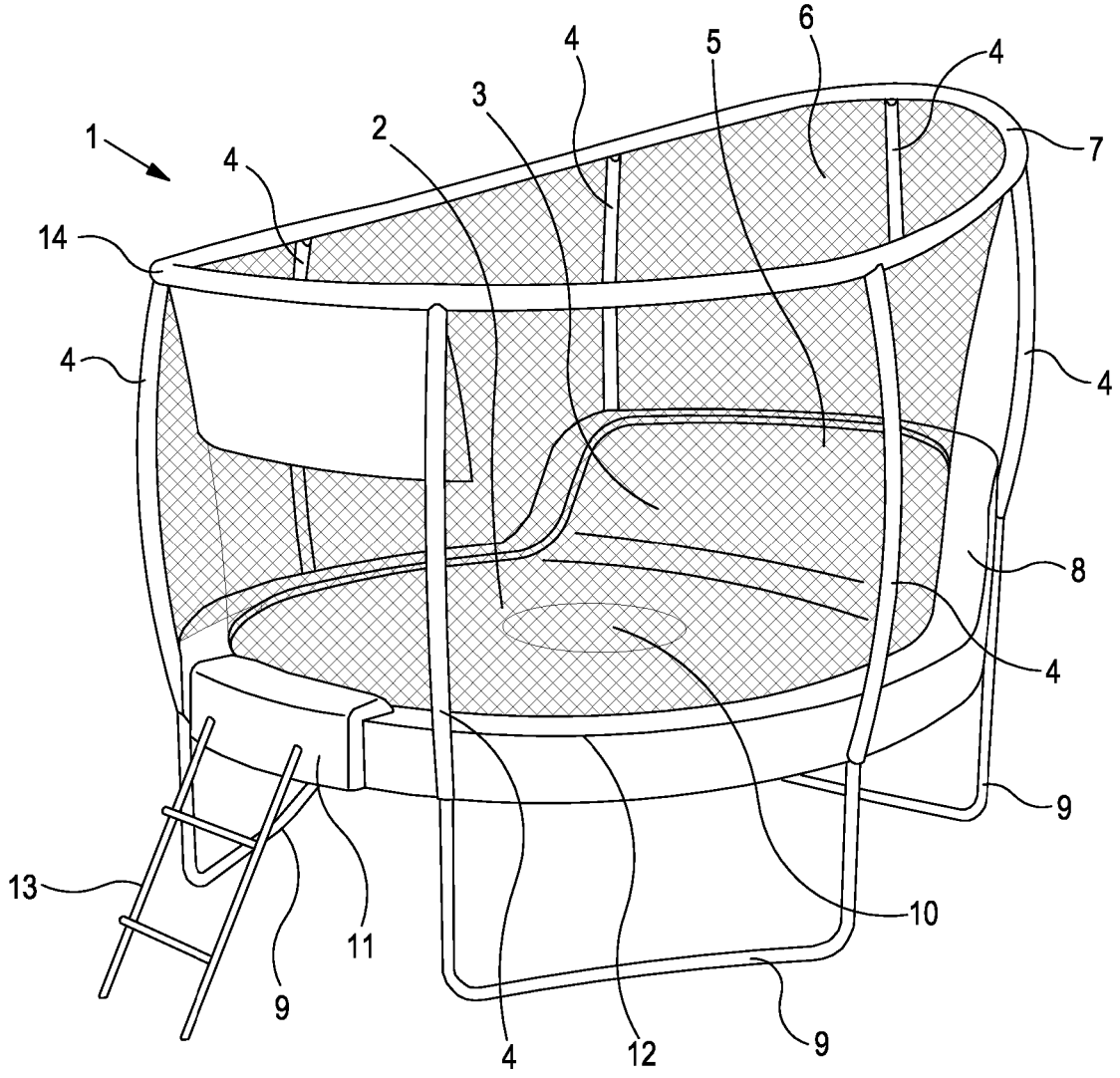
FIG. 1 is a perspective view of an example of a trampoline according to the disclosure.
Figure 2:
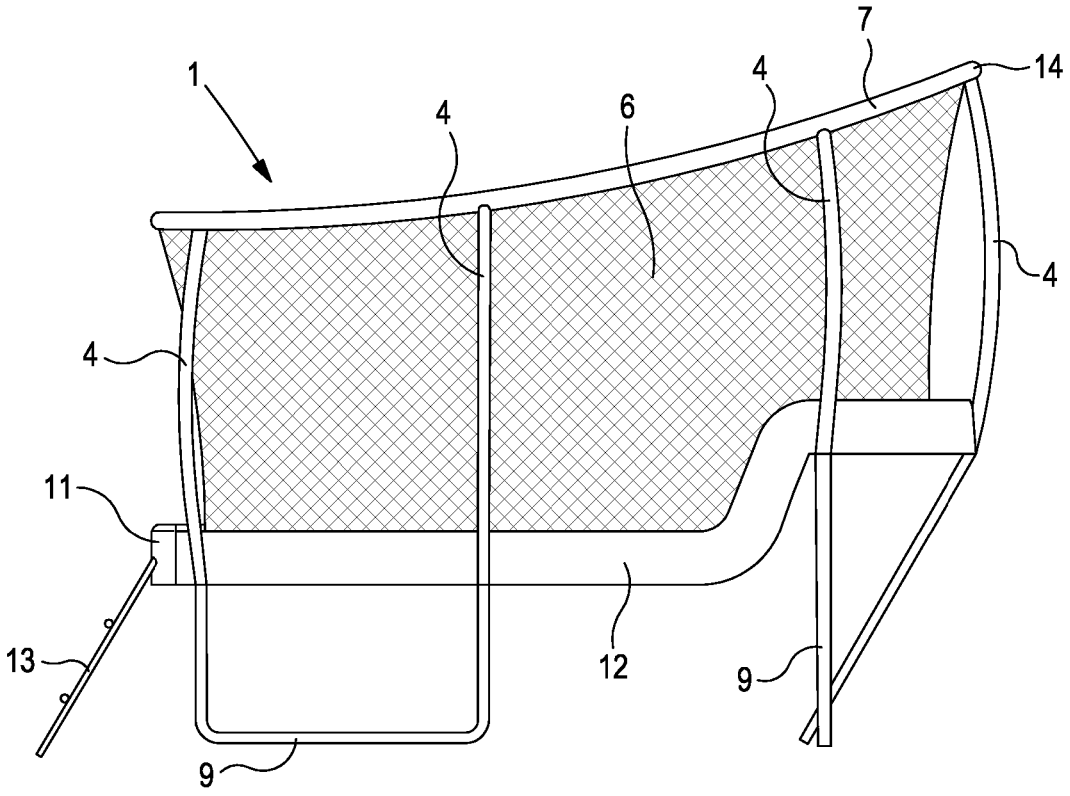
FIG. 2 is a side elevation of the trampoline of FIG. 1.
Figure 3:
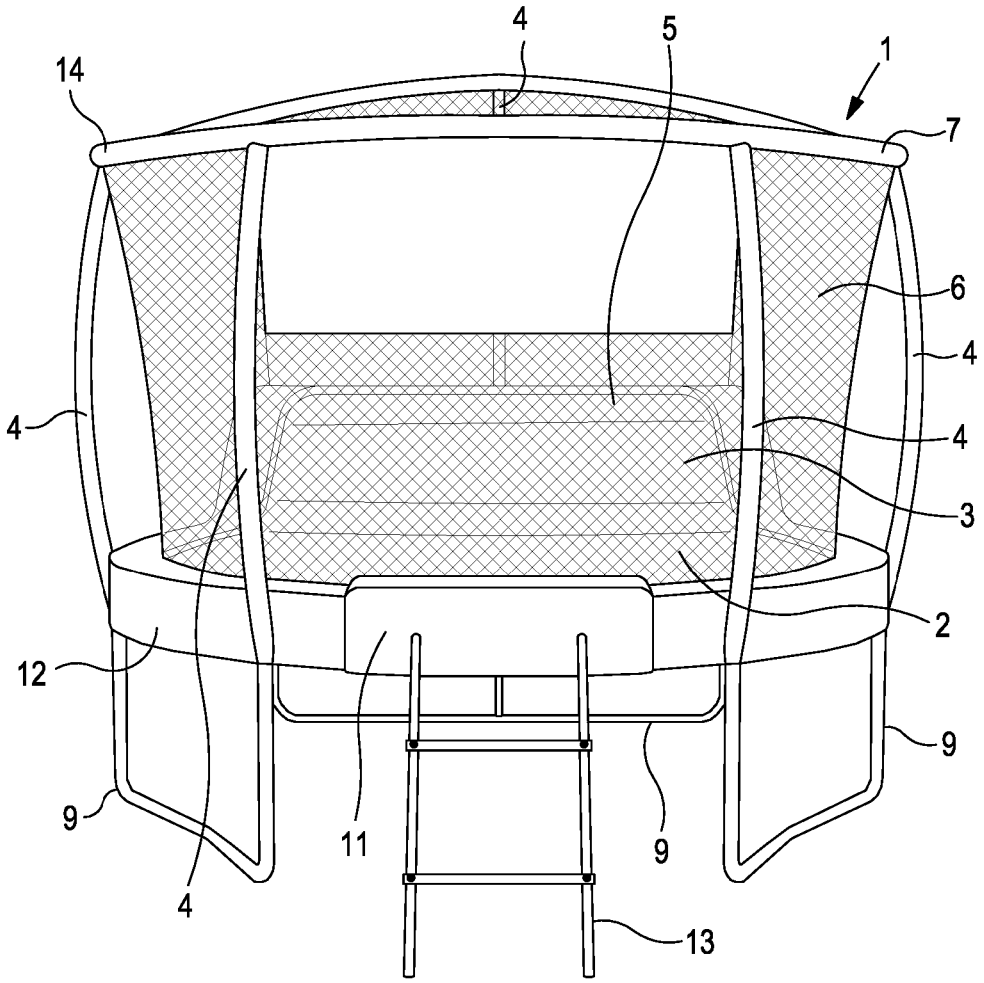
FIG. 3 is a front elevation of the trampoline of FIG. 1.

Referring to FIGS. 1, 2 and 3, there is shown an example of a trampoline 1 according to the present disclosure.

The trampoline 1 comprises a bounce area 10. The bounce area 10 constitutes a flexible bounce mat. The bounce area 10 comprises a first portion 2, a second portion 3 and a third portion 5. The first portion 2, the second portion 3 and the third portion 5 are disposed in different planes from each other. The second portion 3 connects the first portion 2 to the third portion 5. The first portion 2 and the third portion 5 are both substantially horizontal. The first portion 2 has a larger area than the third portion 5. The third portion 5 is higher than the first portion 2. The second portion 3 is disposed in at an angle to the first portion 2 and the third portion 5. In plan view, the bounce area 10 has a teardrop shape.

The trampoline 1 comprises a frame 14 for supporting the bounce area 10. The frame 14 extends around the perimeter of the bounce area 10. The bounce area 10 is connected to the frame 14 by a plurality of resilient members (not shown) such as springs, e.g. coil springs or leaf springs, at spaced-apart intervals around the perimeter of the bounce area 10. The bounce area 10 is held above the ground in tension.

The frame 14 further comprises three legs 9 extending downwards from the height of the bounce area 10. Each leg 9 comprises a plurality of downwardly-extending portions each of which is connected at its lower end to a ground-contacting member, which extends in a generally horizontal direction. The downwardly-extending portion(s) and ground-contacting member of each leg 9 may be integrally formed, i.e. formed as a single piece, or may comprise a plurality of separate pieces that can be attached to each other when assembling the trampoline.

The frame 14 comprises in this embodiment seven support poles 4 extending upwards from the height of the bounce area 10. Each support pole 4 is connected at its upper end to a top member 7, which extends continuously across all of the support poles 4.

A cover 12, which may be padded at least in part, is disposed over the resilient members.

A surround 6 of flexible material, such as netting, is connected to the support poles 4 and the top member 7 to extend around and above the bounce area 10. The surround 6 is connected to the radially inner edge of the cover 12, for example by stitching.

The surround 6 prevents users bouncing on the bounce area 10 from falling on to the resilient members or off the trampoline. The cover 12 restricts external access to the resilient members.

The surround 6 may comprise any suitable entry system for allowing a user to enter and exit the bounce area 10. In the illustrated example embodiment, the surround 6 comprises a first, externally facing, doorway comprising a first aperture, and a second, internally facing doorway comprising a second aperture. The aperture of the internally facing doorway is formed in the material of the surround 6 and provides access between the interior of the surround 6 and an access space of the entry system. The interior wall of the access space is formed from the material of the surround 6, adjacent to the aperture of the internally facing doorway. The first and second apertures are substantially non-aligned with one another and are in communication with one another via an access space. The access space is bounded by an inner wall and an outer wall created from portions of the material of the surround. The access space may have the form of an access tunnel.

A ladder 13 extends down to the ground from an entry pad 11, which is disposed on a portion of the cover 12 and is located adjacent the entry system in the surround 6.

Thus, a user can climb up the ladder 13 on to the entry pad 11 and enter the bounce area via the access space.

A user of the trampoline 1 may bounce up and down on the first portion 2 or the third portion 5 of the bounce area 10. The user may also bounce on the second portion 3. The user may bounce from the third portion 5 on to the first portion 2 and vice versa. If the user is unable to bounce up from the first portion 2 to the third portion 5, the user may scramble or climb over the second portion 3, in order to get from the first portion 2 to the third portion 5. Accordingly, it will be appreciated that the trampoline 1 may provide the user with a more entertaining and/or enjoyable experience than a conventional trampoline.

Various modifications to the above-described example embodiment will be apparent to the person skilled in the art without departing from the scope of the invention.

The bounce area may be formed of a single continuous piece of material. Alternatively, the bounce area may be formed of a plurality of pieces of material, which are joined together by any suitable joining or bonding technique, e.g. by sewing, adhesive or welding.

The second portion (of the bounce area) may be disposed at an angle to the first portion and/or the third portion of up to or at least 10°, up to or at least 20°, up to or at least 30°, up to or at least 45°, up to or at least 60°, up to or at least 75° or up to 90°.

The bounce area may be of any shape or size and may include. The bounce area may comprise any combination or arrangement of portions, in which at least two of the portions are disposed in different planes from each other.

The bounce area may be tiered and/or stepped. The bounce area may comprise any number or combination of tiers and/or steps.

The bounce area may be decorated with any number or combination of markings, colours and/or indicia.

Any suitable number or arrangement of resilient members may connect the bounce area to the frame. Suitable resilient members may include for example flexible rods, e.g. flexible composite rods, or springs such as coil springs or leaf springs.

The frame may comprise a crossbar member, e.g. a padded cross bar member, extending underneath the bounce area at a point where a given portion of the bounce area meets another portion of the bounce area which is disposed in a different plane from the given portion of the bounce area.

The frame may be made at least in part from a metal or an alloy. For instance, the frame may be made at least in part from steel, e.g. powder coated steel, aluminium or an aluminium alloy.

The frame may comprise any number and arrangement of legs and/or support poles.

The frame may not comprise any legs. For instance, in some embodiments, the trampoline may be installed such that the bounce area is located over a hole in the ground.

Any arrangement of support poles or internal skeleton for supporting the surround may be used, and any means of attachment of the surround to the poles may be employed. The surround may be designed to be easily removed from the trampoline for disassembly, and may take advantage of known quick release systems of that purpose.

The surround may be arranged outwardly or inwardly of the resilient members (e.g. springs), which connect the bounce area to the frame.

The trampoline may not comprise a surround. The trampoline may comprise any suitable surround. The surround may comprise any suitable entry system. The entry system may comprise no closure means or may comprise one or more closure means such as zippers.

The trampoline may comprise one or more storage compartments, e.g. for storing a user's shoes. The storage compartment(s) may be provided on or in the surround and/or may be provided on or attached to the cover.

The trampoline may comprise a sunshade, which may be connected to the frame.

The trampoline may comprise a roof, e.g. made of a flexible material such as netting. The roof may comprise the or a sunshade. The roof may be water resistant or waterproof.

Figure 4:
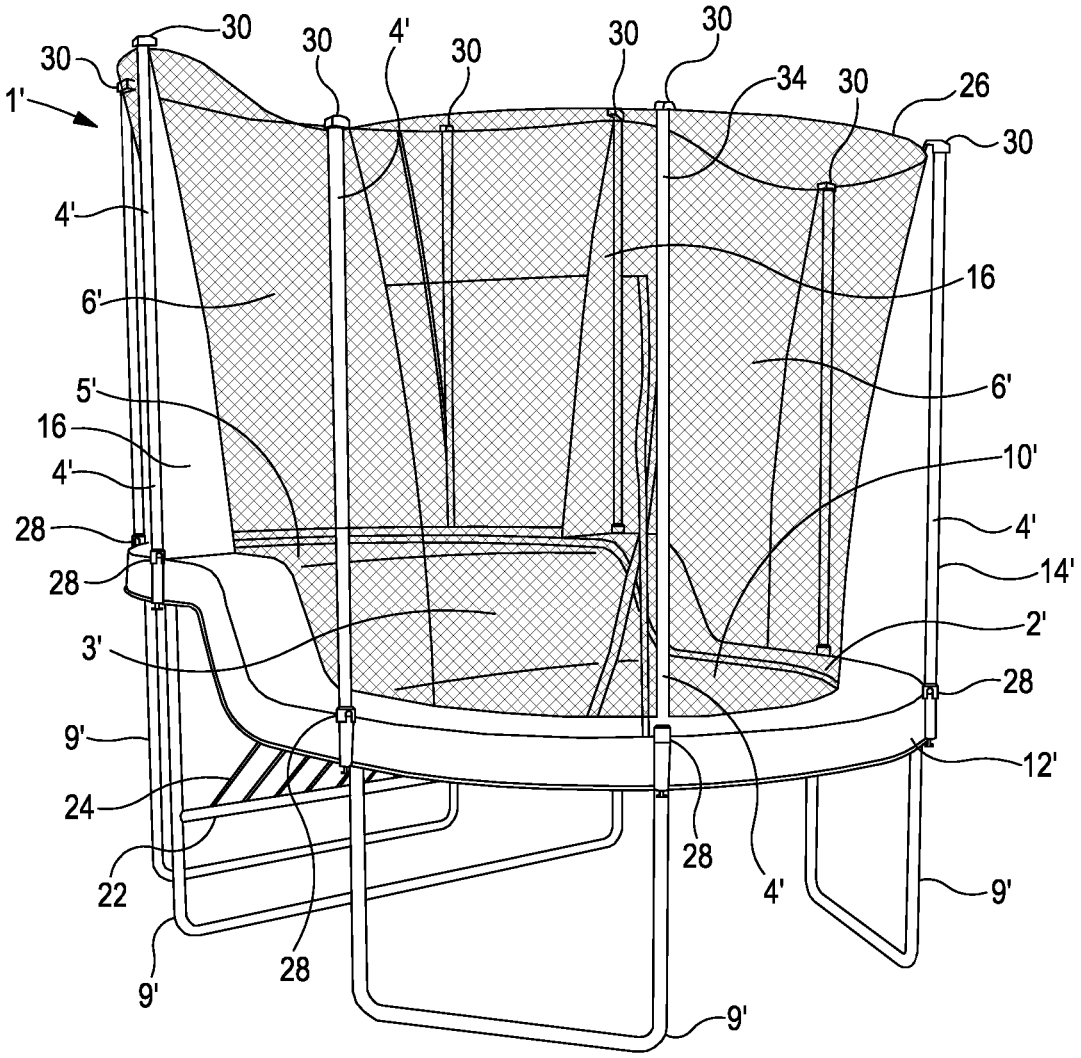
FIG. 4 is a perspective view of another example of a trampoline according to the disclosure.
Figure 5:
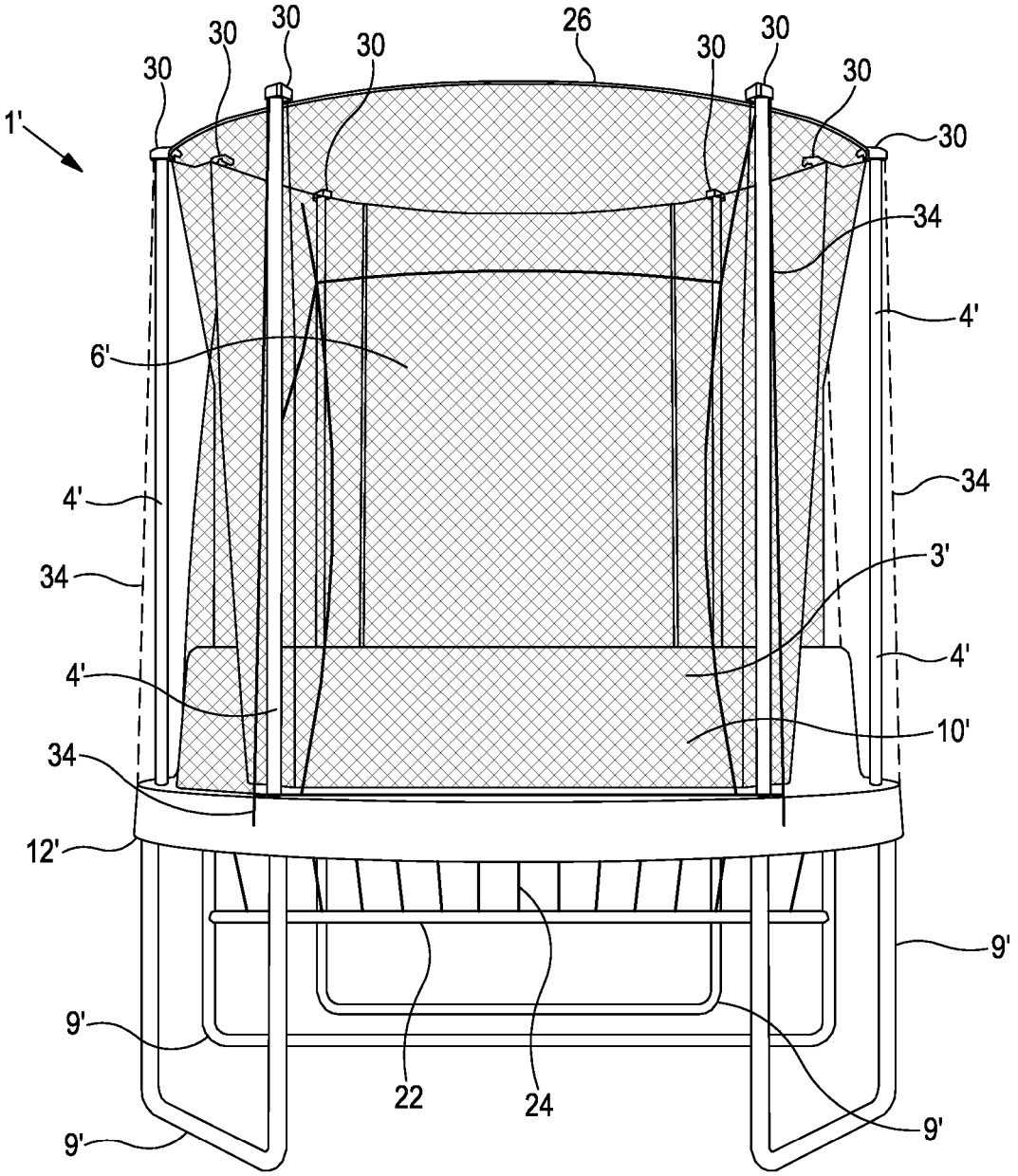
FIG. 5 is a front elevation of the trampoline of FIG. 4.

Referring to FIGS. 4 and 5, there is shown another example of a trampoline 1' according to the present disclosure.

The trampoline 1' comprises a bounce area 10'. The bounce area 10' constitutes a flexible bounce mat. The bounce area 10' comprises a first portion 2', a second portion 3' and a third portion 5'. The first portion 2', the second portion 3' and the third portion 5' are disposed in different planes from each other. The second portion 3' connects the first portion 2' to the third portion 5'. The first portion 2' and the third portion 5' are both substantially horizontal. The first portion 2' has a larger area than the third portion 5'. The third portion 5' is higher than the first portion 2'. The second portion 3' is disposed in at an angle to the first portion 2' and the third portion 5'.

The trampoline 1' comprises a frame 14' for supporting the bounce area 10'. The frame 14' extends around the perimeter of the bounce area 10'. The bounce area 10' is connected to the frame 14' by a plurality of resilient members (not shown) such as springs, e.g. coil springs or leaf springs, at spaced-apart intervals around the perimeter of the bounce area 10'. The bounce area 10' is held above the ground in tension. A cover 12', which may be padded at least in part, is disposed over a portion of the frame and the resilient members around the perimeter of the bounce area 10'.

The frame comprises four legs 9' extending downwards from near to or at the height of the bounce area 10'. Each leg 9' comprises a pair of downwardly-extending portions each of which is connected at its lower end to a ground-contacting member, which extends in a generally horizontal direction. The downwardly-extending portion(s) and ground-contacting member of each leg 9' may be integrally formed, i.e. formed as a single piece, or may comprise a plurality of separate pieces that can be attached to each other when assembling the trampoline V.

A crossbar 22 extends between the downwardly-extending portions of one of the legs 9' beneath the bounce area 10'. A plurality of resilient members 24 connect the crossbar 22 to an underside of the bounce area 10' at a plurality of points along a region of the bounce area where the first portion 2' meets the second portion 3'. The resilient members 24 may comprise elasticated cords or webbing. The resilient members 24 are spaced at intervals along a length of the crossbar 24. The resilient members 24 connecting the crossbar 22 to the underside of the bounce area 10' help to hold the bounce area 10' in tension and to provide the first portion 2' and the second portion 3' of the bounce area 10' with the desired bounce characteristics.

The frame 14' comprises in this embodiment eight support poles 4' extending upwards from the height of the bounce area 10'. Each support pole 4' is substantially straight and extends substantially vertically. The support poles 4' are spaced around the perimeter of the bounce area 10'. In other embodiments, the frame may comprise a different number of support poles. The support poles 4' may be tubular. The support poles 4' may comprise a metal, a composite and/or a plastics material. One or more, e.g. all, of the support poles 4' may have a cushioning member attached thereto. The or each cushioning member may comprise a foam. The or each cushioning member may comprise a tube or cylinder or part-tube or part-cylinder extending around a given support pole along at least a portion of its length.

A surround 6' of flexible material, such as netting, extends around and above the bounce area 10'. The surround 6' is connected to the radially inner edge of the cover 12', for example by stitching.

The surround 6' prevents users bouncing on the bounce area 10' from falling on to the resilient members or off the trampoline. The cover 12' restricts external access to the resilient members around the perimeter of the bounce area 10'.

Two barriers 16 are disposed on opposing sides of the trampoline 1' between a support pole 4' and the surround 6'. Each barrier 16 extends upward from the cover 12 to near to the top of the support pole 4'. Each barrier 16 occupies a substantial portion of the space between the cover 12', the support pole 4' and the surround 6'. The barriers 16 are arranged to prevent a user from being able to clamber along the cover 12' up to the height of the third portion 5'. This may improve user safety by reducing the possibility of a user falling from the height of the third portion 5'. Each barrier 16 may comprise a flexible material such as netting. The barriers 16 may be connected or connectable to the surround 6' by any suitable means, e.g. by stitching or by a plurality of fasteners.

The surround 6' has a support loop 26 extending around its top edge. A top cap 30 on each support pole 4' engages with a connection member 32 disposed on the support loop 26. The support loop 26 may comprise a plurality of support loop sections. The support loop sections may be joined together by one or more the connection members 32. The support loop and/or the support loop sections may comprise a metal, a plastics material or a composite material, e.g. comprising carbon fibre.

Each connection member 32 is connected to a first end of a webbing strap 34. The webbing straps 34 comprise a flexible and substantially inextensible material. Each webbing strap 34 passes through one of the top caps 30 and extends downwardly adjacent one of the support poles 4'. A second end of each webbing strap 34 is provided with an attachment member 36 configured to engage with an attachment point 38 disposed on a lower portion of the support pole 4'. The length of each webbing strap 34 may be adjustable.

The surround 6' is held in an erect configuration (i.e. as shown in FIGS. 4 and 5) when the connection members 32 are received in the top caps 30 and the attachment members 36 are engaged with the attachment points 38 disposed on the lower portions of the support poles 4'. The surround 6' is collapsible. To collapse the surround 6' from the erect configuration, a user can bring the attachment members 36 out of engagement with the attachment points 38, thereby allowing the connection members 32 to come out of engagement with the top caps 30. Erecting and collapsing the surround will be described in more detail below.

An end of each support pole 4' engages with a support socket 28 at a point a short distance above the height of the bounce area 10'. When in the upright position (as shown in FIGS. 4 and 5), the support pole 4' is held securely in a substantially upright orientation by the support socket 28. As will be described in more detail below, the support socket 28 provides a pivot point about which the support pole 4' can be folded in an inward direction towards the bounce area 10', e.g. when the surround 6' is in a collapsed configuration. The support poles 4' remain connected to the support sockets 28 when in an upright orientation (e.g. when the surround 6' is in the erect configuration) and when folded in the inward direction towards the bounce area 10' (e.g. when the surround 6' is in the collapsed configuration).

Figure 6:
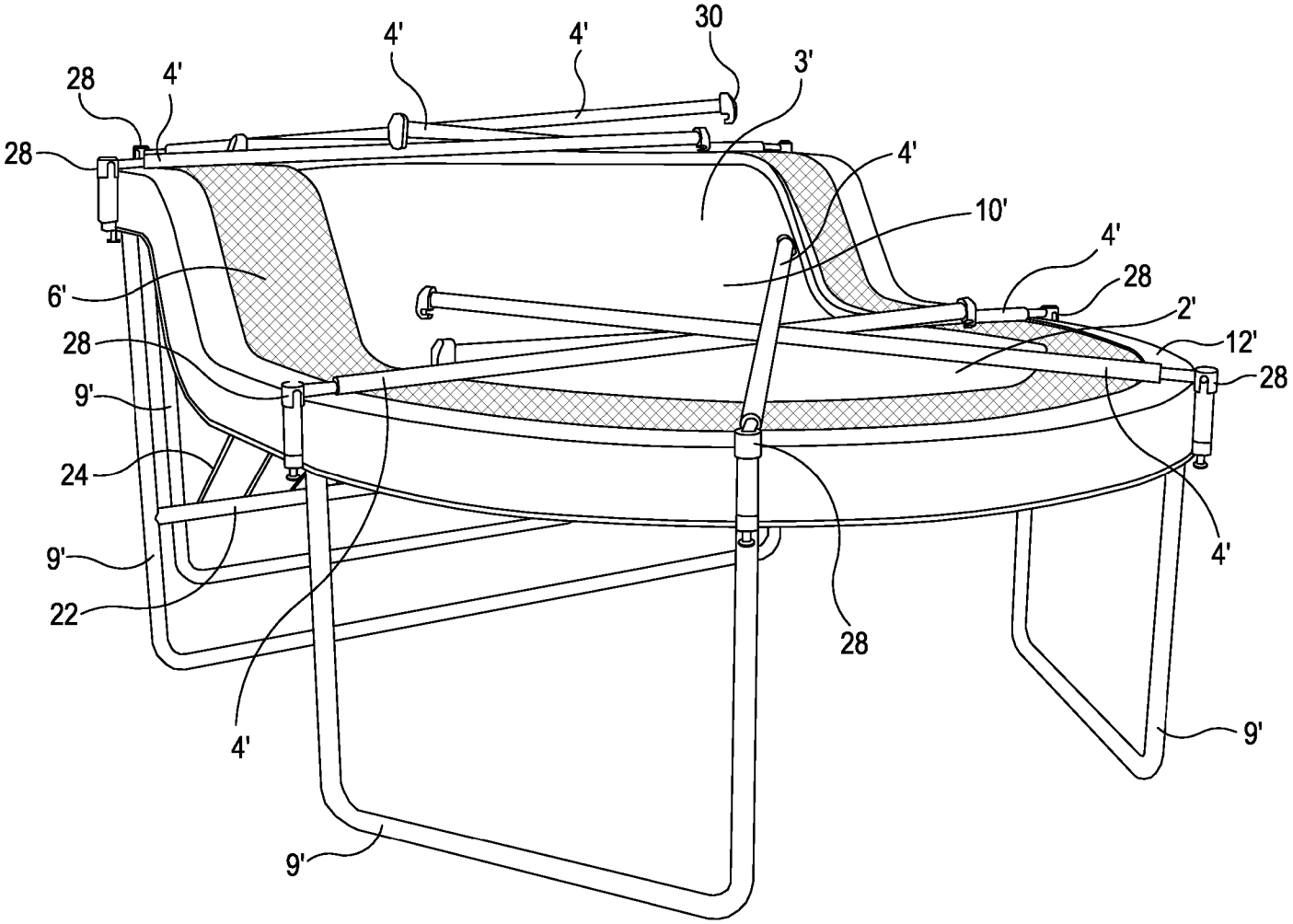
FIG. 6 is a perspective view of the trampoline of FIG. 4 in a folded down configuration.
Figure 7:
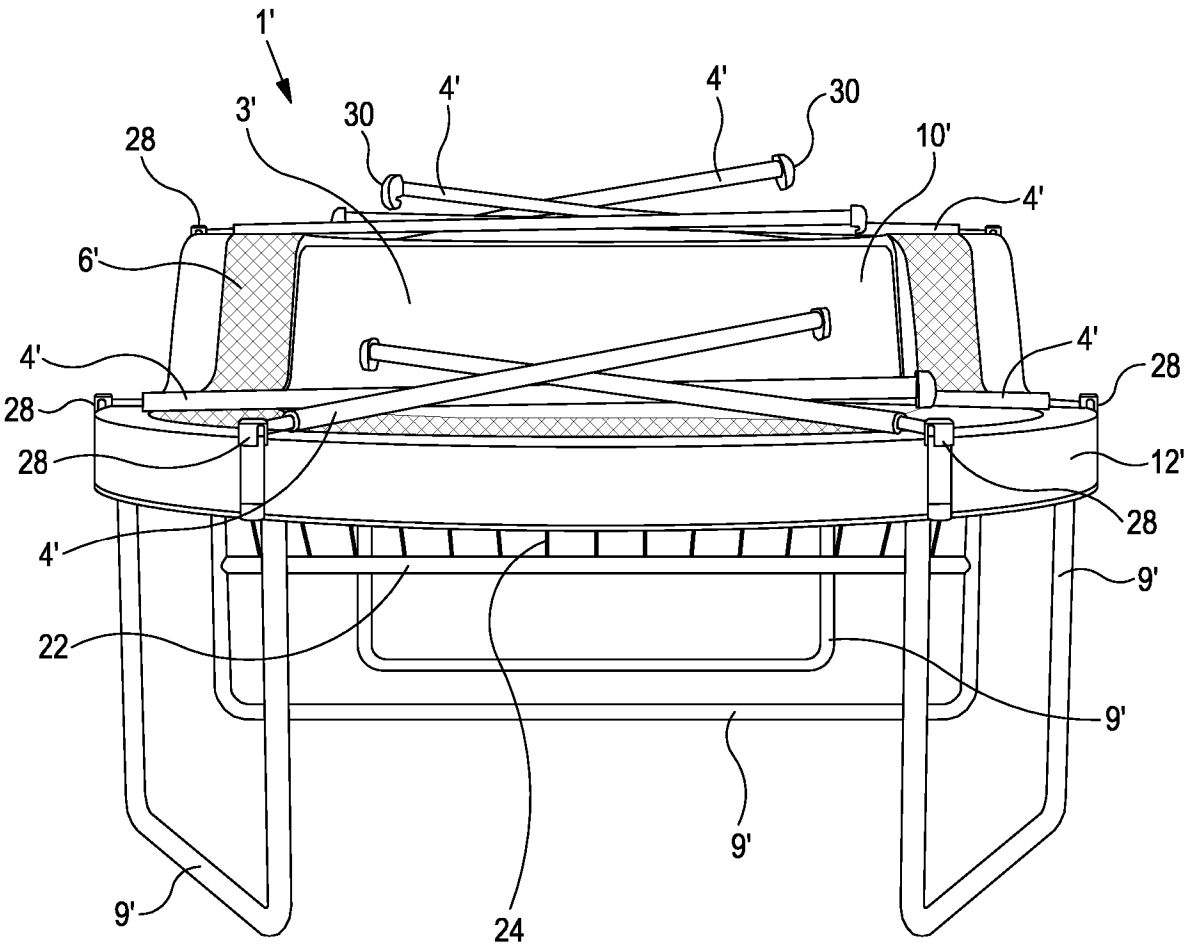
FIG. 7 is a front elevation of the trampoline of FIG. 6.
Figure 8:
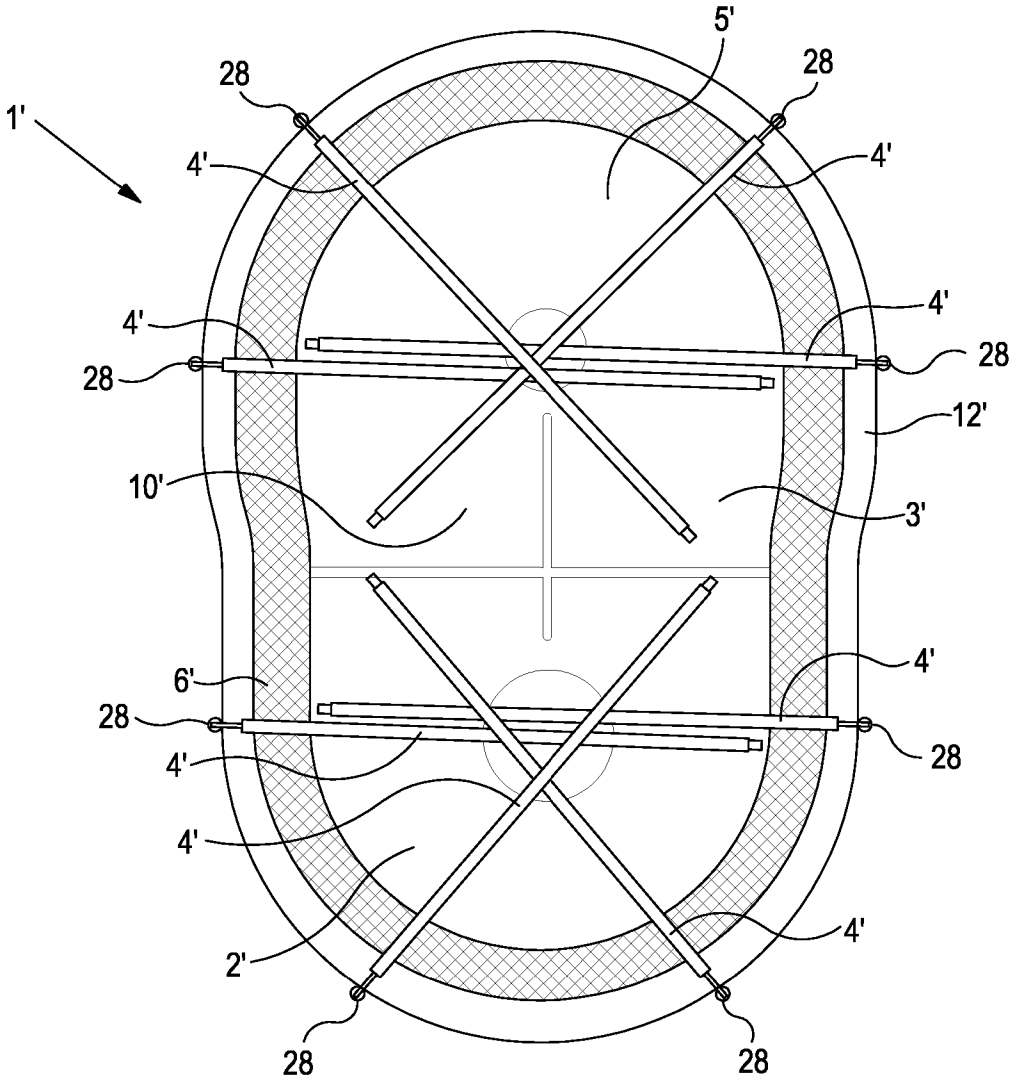
FIG. 8 is a top view of the trampoline of FIG. 6.

FIGS. 6, 7 and 8 show the trampoline 1' with the support poles 4' folded in the inwards direction towards the bounce area 10'. The support poles 4' lie relatively flat over the bounce area 10'. The support poles 4' do not protrude beyond the perimeter of the trampoline 1'.

Conveniently, any cushioning members attached to the support poles 4' need not be removed from the support poles 4' when erecting and/or collapsing the surround 6'. This may make erecting and/or collapsing the surround simpler and quicker. It may also improve safety, since the trampoline 1' may be less likely to be used without the cushioning member(s) attached to the support pole(s) 4'.

Figure 9:
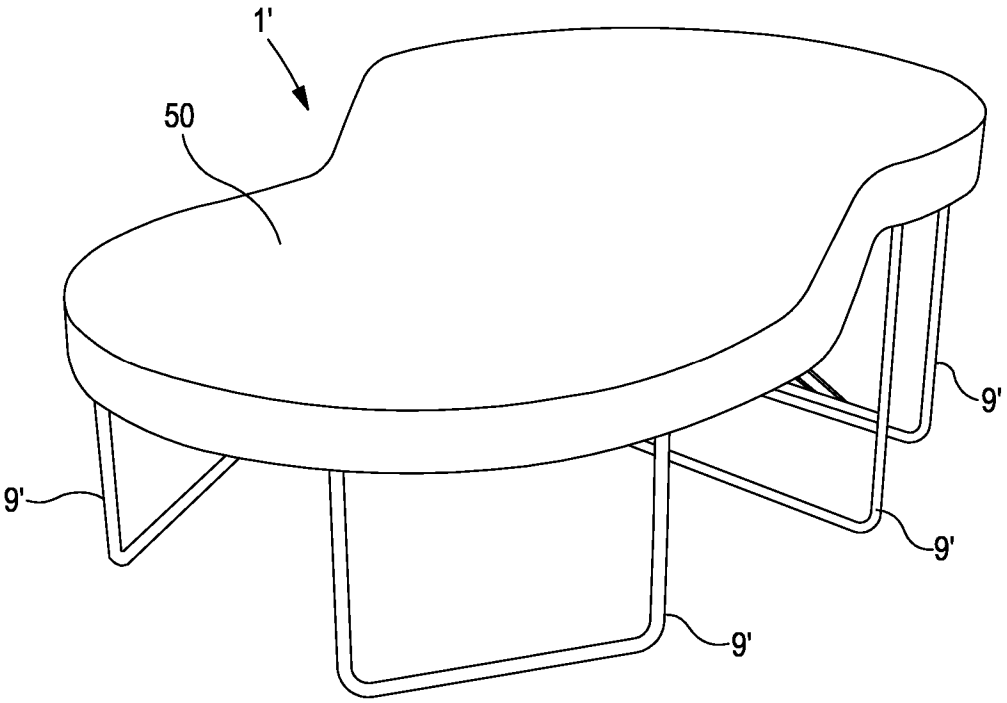
FIG. 9 is a perspective view of the trampoline of FIG. 6 with a protective cover over it.

With the support poles 4' lying relatively flat over the bounce area 10', a protective cover 50 comprising a waterproof membrane can be placed over the trampoline 1', as illustrated in FIG. 9. The protective cover 50 is arranged to cover the bounce area 10', the cover 12', the support poles 4' and the surround 6'. Underneath the protective cover 50, the support poles 4' are connected to the support sockets 28 and the surround 6' is in its collapsed configuration ready to return to its erect configuration as described below. Further, the support poles 4' lying relatively flat over the bounce area 10' may provide a plurality of ridges in the protective cover 50 to limit pooling on, and promote run-off from, the protective cover 50.

Various modifications to the above-described example embodiment will be apparent to the person skilled in the art without departing from the scope of the invention.

The surround 6' may comprise any suitable entry system for allowing a user to enter and exit the bounce area 10'. In the illustrated example embodiments, the surround 6' comprises a first, externally facing, doorway comprising a first aperture, and a second, internally facing doorway comprising a second aperture. The aperture of the internally facing doorway is formed in the material of the surround 6' and provides access between the interior of the surround 6' and an access space of the entry system. The interior wall of the access space is formed from the material of the surround 6', adjacent to the aperture of the internally facing doorway. The first and second apertures are substantially non-aligned with one another and are in communication with one another via an access space. The access space is bounded by an inner wall and an outer wall created from portions of the material of the surround. The access space may have the form of an access tunnel.

A ladder may extend down to the ground from an entry pad, which may be disposed on a portion of the cover 12' and located adjacent to the entry system in the surround 6'. Thus, a user would be able to climb up the ladder on to the entry pad and enter the bounce area 10' via the access space.

A user of the trampoline 1' may bounce up and down on the first portion 2' or the third portion 5' of the bounce area 10'. The user may also bounce on the second portion 3'. The user may bounce from the third portion 5' on to the first portion 2' and vice versa. If the user is unable to bounce up from the first portion 2' to the third portion 5', the user may scramble or climb over the second portion 3', in order to get from the first portion 2' to the third portion 5'. Accordingly, it will be appreciated that the trampoline 1' may provide the user with a more entertaining and/or enjoyable experience than a conventional trampoline.

The bounce area may be formed of a single continuous piece of material. Alternatively, the bounce area may be formed of a plurality of pieces of material, which are joined together by any suitable joining or bonding technique, e.g. by sewing, adhesive or welding.

The second portion (of the bounce area) may be disposed at an angle to the first portion and/or the third portion of up to or at least 10°, up to or at least 20°, up to or at least 30°, up to or at least 45°, up to or at least 60°, up to or at least 75° or up to 90°.

The bounce area may be of any shape or size and may include. The bounce area may comprise any combination or arrangement of portions, in which at least two of the portions are disposed in different planes from each other.

The bounce area may be tiered and/or stepped. The bounce area may comprise any number or combination of tiers and/or steps.

The bounce area may be decorated with any number or combination of markings, colours and/or indicia.

Any suitable number or arrangement of resilient members may connect the bounce area to the frame. Suitable resilient members may include for example flexible rods, e.g. flexible composite rods, or springs such as coil springs or leaf springs.

The frame may comprise a crossbar member, e.g. a padded cross bar member, extending underneath the bounce area at a point where a given portion of the bounce area meets another portion of the bounce area which is disposed in a different plane from the given portion of the bounce area.

The frame may be made at least in part from a metal or an alloy. For instance, the frame may be made at least in part from steel, e.g. powder coated steel, aluminium or an aluminium alloy.

The frame may comprise any number and arrangement of legs and/or support poles.

The frame may not comprise any legs. For instance, in some embodiments, the trampoline may be installed such that the bounce area is located over a hole in the ground.

Any arrangement of support poles or internal skeleton for supporting the surround may be used, and any means of attachment of the surround to the poles may be employed. The surround may be designed to be easily removed from the trampoline for disassembly, and may take advantage of known quick release systems of that purpose.

The surround may be arranged outwardly or inwardly of the resilient members (e.g. springs), which connect the bounce area to the frame.

The trampoline may not comprise a surround. The trampoline may comprise any suitable surround. The surround may comprise any suitable entry system. The entry system may comprise no closure means or may comprise one or more closure means such as zippers.

The trampoline may comprise one or more storage compartments, e.g. for storing a user's shoes. The storage compartment(s) may be provided on or in the surround and/or may be provided on or attached to the cover.

The trampoline may comprise a sunshade, which may be connected to the frame.

The trampoline may comprise a roof, e.g. made of a flexible material such as netting. The roof may comprise the or a sunshade. The roof may be water resistant or waterproof.

FIGS. 10A to 12C show in more detail one of the support poles 4'. FIGS. 13A and 13B show in more detail one of the support sockets 28. Like reference numerals are used to indicate like features from the trampoline 1' shown in FIGS. 4 to 9 and discussed above.

Figures 10A, 10B, 10C, 10D, 10E, 10F:
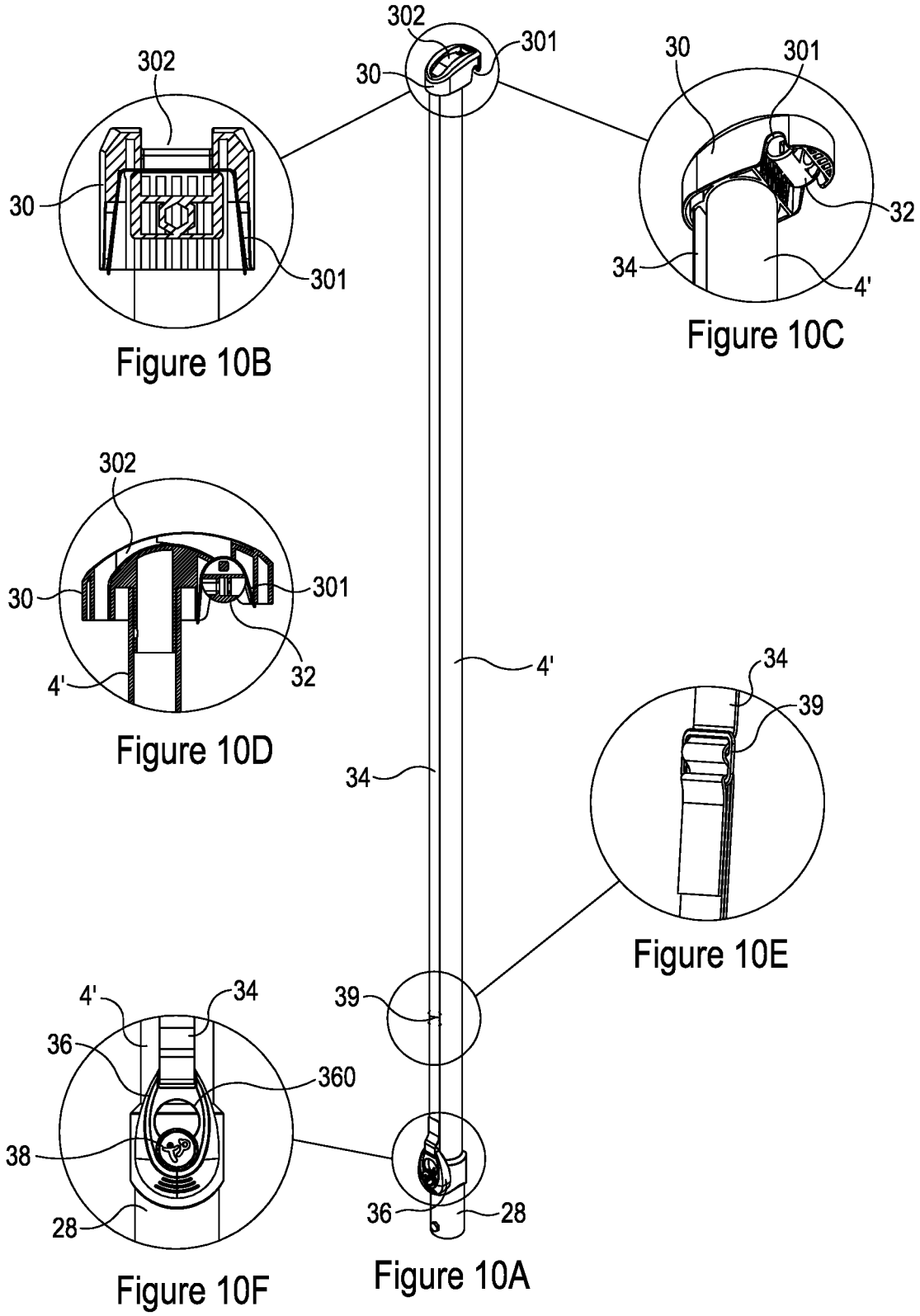
FIG. 10A is a perspective view of one of the support poles shown as part of the trampoline in FIGS. 4 to 9.
FIGS. 10B, 10C, 10D, 10E and 10F show magnified details of selected portions of FIG. 10A.

In FIG. 10A, the support pole 4' is shown in an upright position. An end portion of the support pole 4' is held securely upright within a tubular receiving portion of the support socket 28.

Referring to FIGS. 10B, 10C and 10D as well as FIG. 10A, the top cap 30 mounted on the other (upper) end of the support pole 4' comprises a receiving channel 301 adapted to receive, in use, one of the connection members 32 when the surround 6' is in the erected configuration. The receiving channel 301 may be shaped and dimensioned, e.g. flared or tapered in one or more directions, to guide the connection member 32 into a fully connected position. Consequently, when the surround 6' is in the erected configuration, lateral movement of the connection member 32 within the receiving channel 301 may be reduce, minimised or prevented.

The top cap also provides a guide channel 302 for the webbing strap 34. The guide channel 302 extends from an outboard side of the support pole 4' to an inboard side of the support pole 4'. The webbing strap 34 passing through the guide channel 302 provides a pulley mechanism that enables the surround 6' to be erected and collapsed, in use.

Referring to FIG. 10F as well as FIG. 10A, the attachment member 36 at the end of the webbing strap 34 opposite from the connection member 32 comprises a central aperture 360. The attachment member 36 is engaged with the attachment point 38 on the support socket 28. The attachment point 38 comprises a pin-headed protrusion. The central aperture 360 is shaped and dimensioned to engage with the attachment point.

Referring to FIG. 10E as well as FIG. 10A, a tension adjustment buckle 39 is provided at an intermediate point along the webbing strap 34 to allow adjustment of the webbing strap 34.

In the upright position shown in FIG. 10A, the webbing strap 34 has been pulled in a downward direction such that the connection member 32 is in the fully connected position within the receiving channel 301. The engagement of the attachment member 36 with the attachment point 38 and adjustment of the tension adjustment buckle 39 if necessary act to ensure that the connection member 32 is held securely within the receiving channel 301. Also, the engagement of the attachment member 36 with the attachment point 38 (and adjustment of the tension adjustment buckle 39 if necessary) act to prevent the support pole 4' from being inadvertently or accidentally removed from the tubular receiving portion of support socket 28, thereby ensuring that the support pole 4' remains upright, in use.

Accordingly, when all of the support poles 4' are in the upright configuration shown in FIG. 10A with the connection member 32 in the fully connected position within the receiving channel 301, since the connection member 32 will be attached to the support loop 26, the surround 6' will be in the erect configuration.

Figures 11A, 11B, 11C:
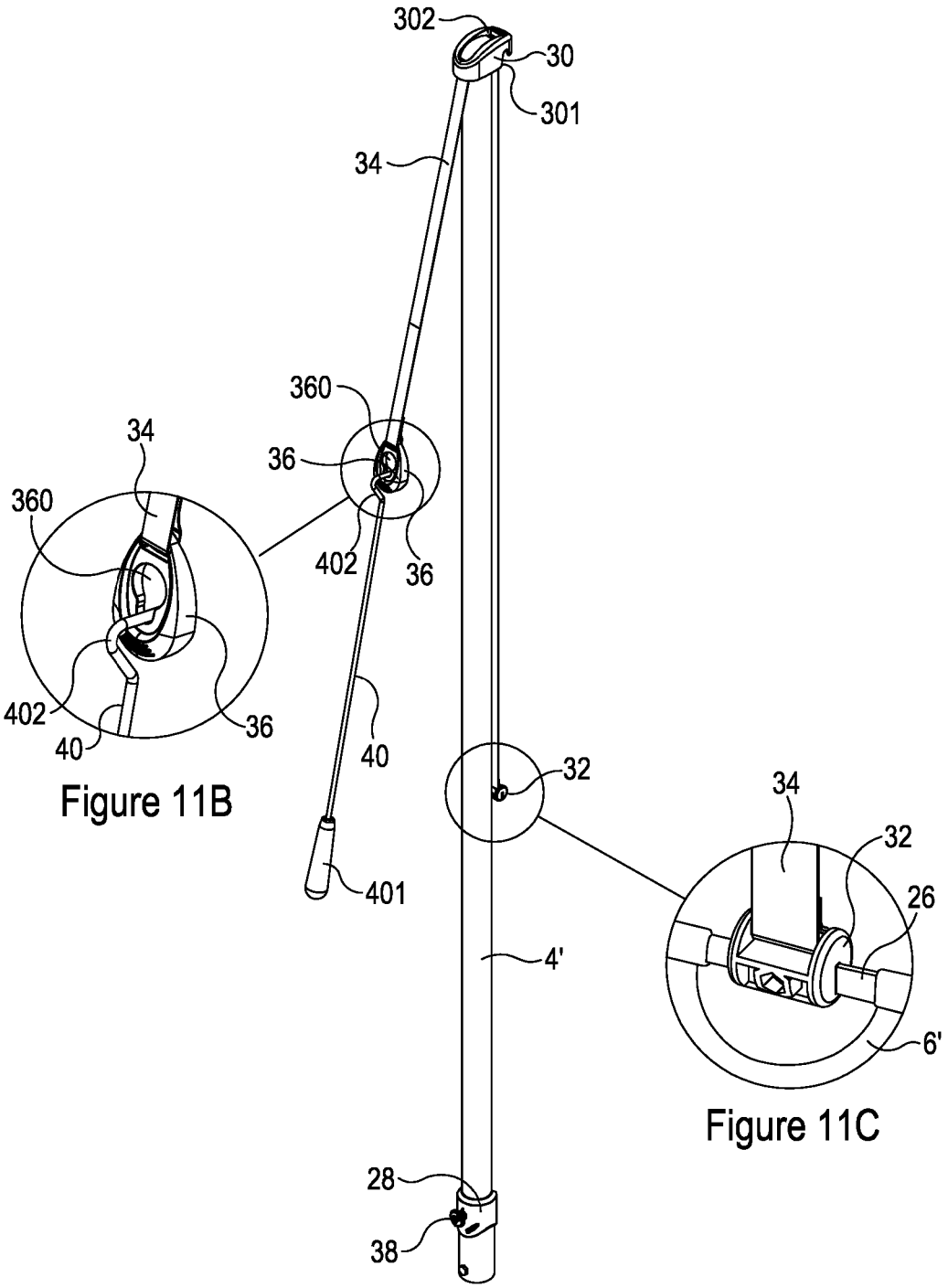
FIG. 11A is another perspective view of the support pole of FIG. 10A in an alternative configuration.
FIGS. 11B and 11C show magnified details of selected portions of FIG. 11A.

In FIG. 11A, the support pole 4' is shown in the upright position. The webbing strap 34 is shown at a mid-way point between the erect configuration and the collapsed configuration of the surround 6'. The attachment member 36 is not engaged with the attachment point 38. FIGS. 11B and 11C show magnified details of selected portions of FIG. 11A The trampoline 1' and/or surround 6' may be provided with a wand 40. The wand 40 comprises an elongate member with a handle 401 at one end and a hook 402 at the other. The wand 40 may enable a user to erect and/or collapse the surround 6' from ground level, which may be safer and/or more convenient. The provision of the wand 40 is desirable but not essential, since increasing the length of the webbing strap 34 could enable a user to erect and/or collapse the surround 6' from ground level. However, increasing the length of the webbing strap 34 could increase cost and may not be aesthetically pleasing.

The hook 402 is configured to engage with the central aperture 360 and allows the wand 40 to be used to pull the webbing strap in a downward direction when erecting the surround 6' or to control upward movement of the attachment member 36 when the surround 6' is being collapsed.

Referring to FIGS. 12A to 13B, operation of the support socket 28 will be described.

Figures 12A, 12B, 12C, 13A, 13B:
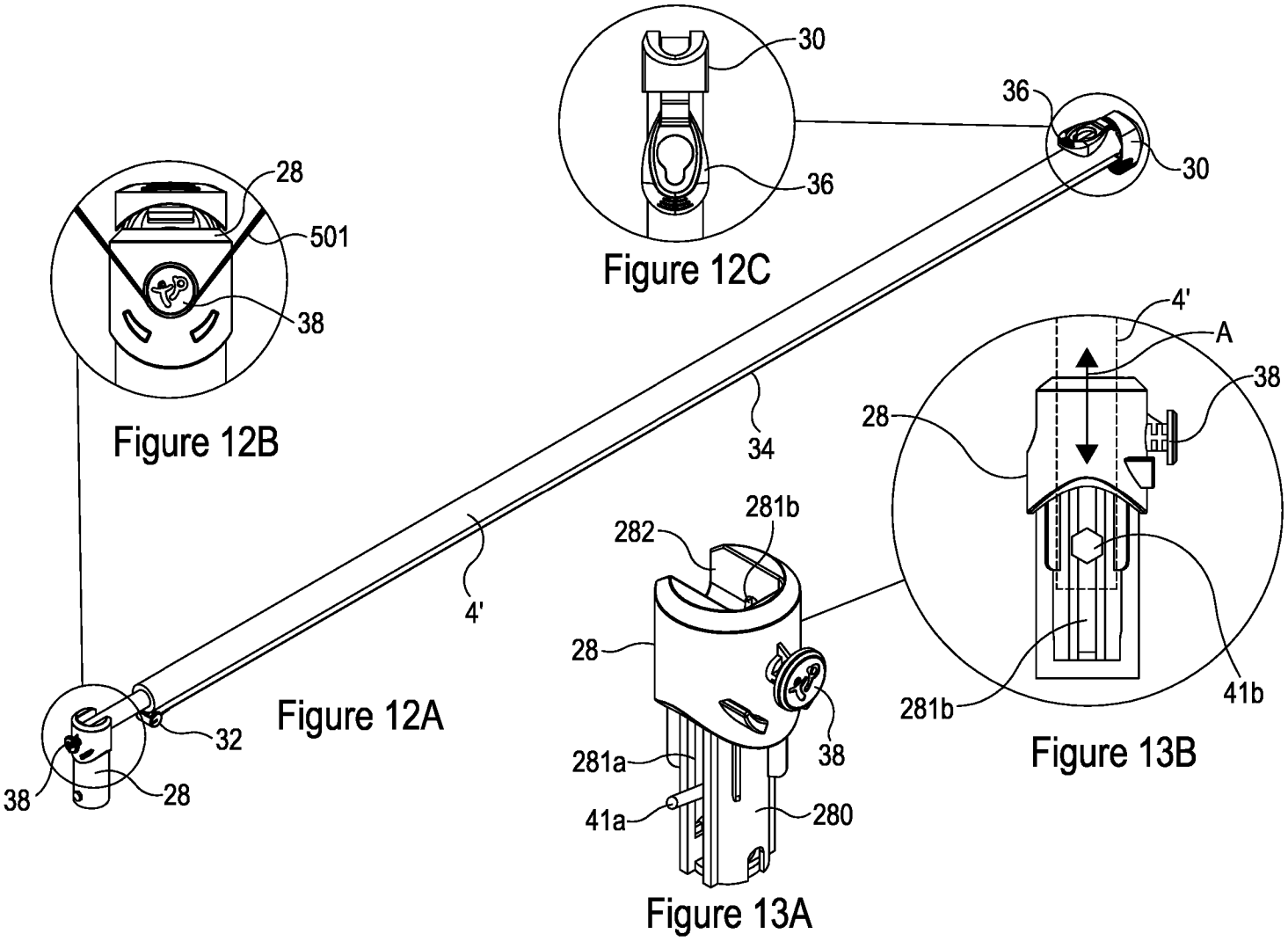
FIG. 12A is another perspective view of the support pole of FIG. 10A in an alternative configuration.
FIGS. 12B and 12C show magnified details of selected portions of FIG. 12A.
FIGS. 13A and 13B show in detail an example of one of the support sockets shown as part of the trampoline in FIGS. 4 to 9.

In FIG. 12A, the support pole 4' is shown in a non-upright position. The support pole 4' has been folded about a pivot axis in the support socket 28 in an inward direction such that the support pole 4' can lie relatively flat over the bounce area 10'. The webbing strap 34 is arranged such that it would be with the surround 6' in the collapsed configuration. The connection member 32 is located near the support socket 28 and the attachment member 36 is located near the top cap 30. The attachment member 36 cannot pass through the guide channel 302 in the top cap 30. Hence, the attachment member 36 is readily accessible, e.g. using the wand 40, when it is desired to (re-)erect the surround 6'. The surround 6' is lowered into its collapsed position before the support poles 4' are folded over about the pivot axis in the support socket 28.

Conveniently, the attachment point 38 may provide a connection point for a strap 501 (FIG. 12B) attached to a protective cover (e.g. protective cover 50). The top cap 30 and/or the attachment member 36 may be adapted to provide a connection point for a protective cover (e.g. protective cover 50).

Referring in particular to FIGS. 13A and 13B, the support socket 28 comprises a tubular receiving portion 280 adapted to receive and an end portion of the support pole 4'. The tubular receiving portion 280 comprises a pair of opposing longitudinally-extending guide slots 281*a*, 281*b*. At an upper end, the tubular receiving portion 280 communicates with a lateral channel 282, which extends to an edge of the support socket 28 in a direction transverse to the longitudinally-extending guide slots 281*a*, 281*b*.

The lower portion of the support pole 4' comprises a pair of pins 41*a*, 41*b* protruding therefrom. The pins 41*a*, 41*b* are received in longitudinally-extending guide slots 281*a*, 281*b* respectively.

As indicated by arrow A in FIG. 13B, the support pole 4' may be moved longitudinally within the tubular receiving portion 280 of the support socket 28. The pins 41*a*, 41*b* can thus move within the longitudinally-extending guide slots 281*a*, 281*b* respectively. When the support pole 4' is moved such that the pins 41*a*, 41*b* are at or near an upper end of their respective longitudinally-extending guide slots 281*a*, 281*b*, the support socket 28 is shaped and dimensioned such that the support pole 4' can be pivoted about a pivot axis passing through the pins 41*a*, 41*b* and received in the lateral channel 282. The support pole 4' may therefore be in the non-upright position, as shown in FIG. 12A.

The support socket 28 may comprise a sleeve (not shown), which encloses the tubular receiving portion 280. Accordingly, the longitudinally-extending guide slots 281*a*, 281*b* and the pins 41*a*, 41*b* may be inaccessible to the user, thereby reducing any risk of user injury, e.g. due to pinching of fingers or thumbs or entrapment of loose clothing.

The collapsible surround, e.g. the surround 6', described herein may be relatively simple and/or safe to erect and/or to collapse. Accordingly, the surround may be more easily collapsed, and the trampoline protected with a suitable protective cover, when the trampoline is not in use, which may increase the service lifetime of the trampoline by protecting it better in inclement weather. Similarly, when a user wants to use the trampoline again, it may be relatively easy, safe and quick to erect the surround. One person may easily erect or collapse the surround from ground level.

The trampoline 1' may be stored between uses with the surround 6' in the collapsed configuration, e.g. as shown in FIGS. 6, 7 and 8. To make the trampoline 1' ready for use, a user must first move each support pole 4' into an upright orientation held within its associated support socket 28. Conveniently, this may be done by pivoting the support pole 4' about the pivot axis passing through the pins 41*a*, 41*b* and then allowing the support pole 4' to move downwards into the tubular receiving portion 280 with the pins 41*a*, 41*b* moving downwards within their respective guide slots 281*a*, 281*b*. Using the wand 40, the user may then pull downwards on the attachment member 36 to move the webbing strap through the guide channel 302 in the top cap 30 and lift the connection member 32 into the receiving channel 301. The attachment member 36 may then be engaged with the attachment point 38 and the tension adjustment buckle 39 adjusted if necessary. These steps are repeated for all of the attachment members 36, thereby raising the support loop 26 and hence bringing the surround 6' into the erect configuration The surround 6' may be collapsed from the erect configuration (e.g. as shown in FIGS. 4 and 5) to the collapsed configuration (e.g. as shown in FIGS. 6, 7 and 8). A simple two-stage method may be employed. This method may be carried out by one person from the ground without any need to climb on to the trampoline. The method of collapsing the surround 6' may involve carrying out the steps of the above-described method of erecting the surround 6' in reverse order.

Generally, the first stage may comprise disengaging the attachment members 36 from the attachment points 38 on all of the support poles 4' in turn and allowing the surround 6' to collapse under its own weight.

The second stage may generally comprise folding each support pole 4' in an inward direction over the bounce area 10'.

It will be appreciated that the surround 6' may be collapsed and/or erected while the support poles 4' are in an upright orientation. Consequently, there is no significant weight on the support poles 4' when they are folded in the inward direction over the bounce area 10' or vice versa when collapsing or erecting the surround respectively.

This contrasts with some known collapsible trampoline surrounds, which require the user to lift the support poles out of their sockets whilst the surround is connected to the support poles. This means that the support poles seem to weigh more, as they are under the tension of the still-connected surround. It gets progressively harder to lift each subsequent support pole out of its socket.

The collapsible surround described herein may be used in conjunction with any trampoline, not only a trampoline having a bounce area configured such that a first portion of the bounce area is disposed in a first plane and a second portion of the bounce area is disposed in a second plane, the second plane being different from the first plane.

The collapsible surround described herein may be used in conjunction with play apparatuses other than trampolines. For instance, the collapsible surround may be adapted to provide a collapsible flexible safety barrier for use with other apparatuses or spaces such as inflatable child's play apparatus, play areas, ball pools, playpens and other elevated platforms which are otherwise at least partially open-sided.

It will be understood that the invention is not limited to the embodiments above-described and various modifications and improvements can be made without departing from the concepts herein. Except where mutually exclusive, any of the features may be employed separately or in combination with any other features and the disclosure extends to and includes all combinations and sub-combinations of one or more features described herein.

The invention claimed is:

1. A safety barrier for use with a play apparatus, comprising: at least one support pole and a barrier element, wherein a portion of the barrier element is detachably connectable directly or indirectly to the at least one support pole, the barrier element having an erect configuration and a collapsed configuration, wherein in the erect configuration the portion of the barrier element is connected directly or indirectly to the at least one support pole and in the collapsed configuration the portion of the barrier element is not connected directly or indirectly to the at least one support pole, the safety barrier further comprising:

a support socket for receiving a first end of the at least one support pole, the support socket comprising an attachment point and a receiving portion for holding the at least one support pole in an erect configuration, wherein the at least one support pole is movable within the receiving portion to a location where the at least one support pole is pivotable relative to the support socket;

a top cap provided at a second end of the at least one support pole, the top cap comprising a guide channel and a receiving channel; and one or more elongate control members, each of the one or more elongate control members having a first end connected directly or indirectly to the barrier element and a connection member, a second end of each of the one or more elongate control members being provided with an attachment member configured to engage with the attachment point disposed on the support socket, the one or more elongate control members passing through the guide channel in the top cap to provide a pulley mechanism to enable the barrier element to be moved between the erect and collapsed configurations, wherein the barrier element is held in the erect configuration by pulling the one or more elongate control members in a downward direction such that the connection member is received within the receiving channel of the top cap and the attachment member is engaged with the attachment point on the support socket, and wherein engagement of the attachment member with the attachment point prevents removal of the at least one support pole from the support socket to maintain the at least one support pole in the erect orientation.

2. The play apparatus comprising a play area and the safety barrier according to claim 1, the safety barrier arranged at an edge of the play area.

3. A trampoline comprising a frame, a bounce area connected to the frame by a plurality of resilient members, wherein the bounce area is configured such that a first portion of the bounce area is disposed in a first plane and a second portion of the bounce area is disposed in a second plane, the second plane being different from the first plane and a collapsible surround extending above and at least partially around the bounce area, wherein the collapsible surround comprises the safety barrier according to claim 1.

4. A kit of parts arranged to be assembled to form the trampoline according to claim 3.

5. A kit of parts arranged to be assembled to form the safety barrier according to claim 1.

6. The safety barrier according to claim 1 wherein the barrier element comprises a support loop extending around a top end of the barrier element, the connection member being disposed on the loop.

7. The safety barrier according to claim 1 wherein the receiving channel of the top cap is flared or tapered to guide the connection member into a fully received position.

8. The safety barrier according to claim 1, wherein the attachment member comprises a central aperture and the attachment point comprises a pin-headed protrusion disposed on the support socket.

9. The safety barrier according to claim 1 further comprising a wand having an elongate member with a handle at one end and a hook at the other configured to engage with the attachment member of the one or more elongate control members to effect movement of a respective elongate control member of the one or more elongate control members through the guide channel.

10. The safety barrier according to claim 1, wherein the receiving portion of the support socket comprises a tubular receiving portion having a pair of opposing longitudinally-extending guide slots, an upper end of the tubular receiving portion communicating with a lateral channel that extends to an edge of the support socket in a direction transverse to the longitudinally-extending guide slots, the lower portion of a support pole of the at least one support pole comprising a pair of pins protruding therefrom for receipt within the pair of opposing longitudinally-extending guide slots whereby the pair of pins are movable within the pair of longitudinally extending guide slots and, when the pair of pins are at or near an upper end thereof, the support pole can pivot about a pivot axis passing through the pair of pins and be received in the lateral channel to place the support pole in a non-upright, collapsed orientation.

* * * * *